US008079395B2

(12) United States Patent
Fox et al.

(10) Patent No.: US 8,079,395 B2
(45) Date of Patent: Dec. 20, 2011

(54) QUICK CHANGE KNIFE BLADE ASSEMBLY FOR A TAPE ROLL DISPENSING CARTRIDGE ASSEMBLY OF A CASE SEALING MACHINE

(75) Inventors: Bryce J. Fox, Honesdale, PA (US); William J. Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 286 days.

(21) Appl. No.: 12/073,138

(22) Filed: Feb. 29, 2008

(65) Prior Publication Data

US 2009/0217535 A1 Sep. 3, 2009

(51) Int. Cl.
*B32B 38/00* (2006.01)
*B32B 38/04* (2006.01)
*B26B 1/00* (2006.01)

(52) U.S. Cl. ..... 156/526; 156/510; 156/523; 156/475; 156/477.1; 30/336; 30/337; 30/338; 30/339

(58) Field of Classification Search ..... 156/250, 156/252, 256, 475, 477.1, 478–480, 486–489, 156/493, 516, 517, 510, 523, 526; 30/336–339
See application file for complete search history.

(56) References Cited

U.S. PATENT DOCUMENTS

| | | | | | |
|---|---|---|---|---|---|
| 2,668,997 | A * | 2/1954 | Irvin et al. | ..... | 24/632 |
| 3,510,921 | A * | 5/1970 | Gillmore | ..... | 24/632 |
| 4,386,609 | A * | 6/1983 | Mongeon | ..... | 606/53 |
| 5,228,943 | A * | 7/1993 | Vasilakes | ..... | 156/468 |
| 5,265,343 | A * | 11/1993 | Pascaloff | ..... | 30/339 |
| 5,615,531 | A * | 4/1997 | Nakai et al. | ..... | 53/136.4 |
| 6,694,624 | B2 * | 2/2004 | Stefanopulos et al. | ..... | 30/392 |

* cited by examiner

*Primary Examiner* — Philip Tucker
*Assistant Examiner* — Christopher C Caillouet
(74) *Attorney, Agent, or Firm* — Law Offices of Steven W. Weinrieb

(57) ABSTRACT

A quick change knife blade assembly, for use in conjunction with a tape roll dispensing cartridge assembly of a case sealing machine, comprises a knife blade mounted upon a knife blade mounting plate. A pin plate is fixedly connected to mounting pins passing through the knife blade, and springs are interposed between the pin plate and the mounting plate so as to normally bias the pin plate to a position at which the mounting pins prevent the removal of the knife blade from the mounting plate. When the pin plate is depressed against the biasing forces of the springs, the mounting pins are moved so as to permit the knife blade to be removed from the mounting plate.

11 Claims, 1 Drawing Sheet

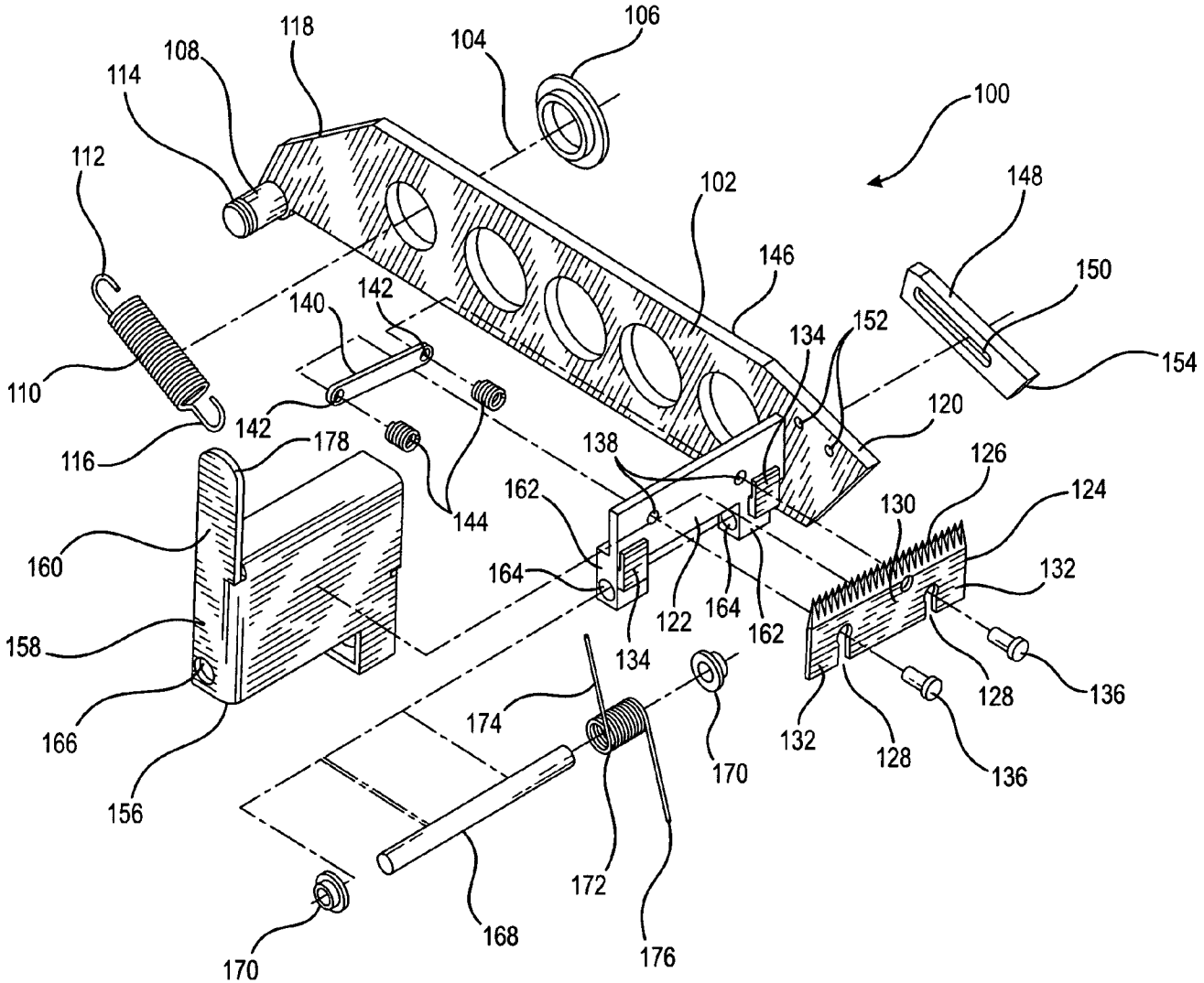
100
102
104
106
108
110
112
114
116
118
120
122
124
126
128
130
132
134
136
138
140
142
144
146
148
150
152
154
156
158
160
162
164
166
168
170
172
174
176
178

QUICK CHANGE KNIFE BLADE ASSEMBLY FOR A TAPE ROLL DISPENSING CARTRIDGE ASSEMBLY OF A CASE SEALING MACHINE

FIELD OF THE INVENTION

The present invention relates generally to carton or case sealing machines, and more particularly to a new and improved quick change knife blade assembly for use in conjunction with a tape roll dispensing cartridge assembly of the carton or case sealing machine wherein the knife blade or cutting member can be quickly replaced or exchanged by means of operator personnel, in lieu of maintenance personnel, as a result of a simple manual manipulation of particular structural components of the knife blade assembly without the need for any special tools.

BACKGROUND OF THE INVENTION

During the operation of carton or case sealing machines, numerous cartons or cases will be sealed by means of one or more tape roll dispensing cartridge assemblies which not only dispense the carton or case sealing tapes and apply the same to the carton or case, but in addition, comprise knife blade assemblies for cutting or severing the sealing tape at predetermined times during the carton or case sealing operational cycle so as to conclude the carton or case sealing operation. It can therefore be appreciated that after numerous cartons or cases have in fact been sealed, various component parts of the tape roll dispensing cartridge assemblies, such as, for example, the knife blades or cutting members, will begin to wear and will accordingly need to be replaced. Conventionally, such replacement procedures have been performed by maintenance personnel in view of the fact that special tools have been required in order to remove the knife blade assemblies of the tape roll dispensing cartridge assemblies from the remaining structural components of the tape roll dispensing cartridge assemblies, and that the same tools would then be required to exchange or replace the worn knife blade assemblies with new knife blade assemblies. Accordingly, when, for example, the knife blade assemblies need to be replaced, not only is it expensive to employ such maintenance personnel, but just as importantly, such procedures are inordinately time-consuming in that it usually takes a considerable amount of time for the maintenance personnel to arrive and replace the knife blade assemblies, during which time the carton or case sealing production line needs to be stopped and effectively shut down. This obviously results in a loss of valuable production or carton or case flow-through time which adds to the operative expenses of the overall carton or case sealing manufacturing operations.

A need therefore exists in the art for a new and improved knife blade assembly for use in conjunction with a tape roll dispensing cartridge assembly of a carton or case sealing machine wherein the knife blade or cutting member can be quickly replaced or exchanged by means of operator personnel, in lieu of maintenance personnel, as a result of simple manual manipulations of particular structural components of the knife blade assembly without the need for any special tools.

SUMMARY OF THE INVENTION

The foregoing and other objectives are achieved in accordance with the teachings and principles of the present invention through the provision of a new and improved quick change knife blade assembly for a tape roll dispensing cartridge assembly of a carton or case sealing machine which comprises a mounting plate upon which the knife blade or cutting member is removably mounted. More particularly, the mounting plate has a pair of transversely spaced apertures defined therein, and a pair of knife blade mounting pins are adapted to be inserted through the apertures defined within the mounting plate. The mounting pins have first relatively small diameter portions, and second relatively large diameter portions, and the knife blade or cutting member is provided with a pair of key-hole slots each one of which conventionally comprises a relatively narrow elongated slot portion and a relatively enlarged circular portion. The mounting pins are also adapted to pass through a pin plate which is mounted in a spring-biased manner upon the mounting plate so as to effectively force the second relatively large diameter portions of the mounting pins to normally be disposed within the relatively enlarged circular portions of the key-hole slots defined within the knife blade or cutting member. In this manner, since the second relatively large diameter portions of the mounting pins are larger than the width dimensions of the elongated slot portions of the key-hole shaped slots defined within the knife blade or cutting member, the mounting pins cannot, in effect, pass through the relatively narrow slot portions of the key-hole slots defined within the knife blade or cutting member so that the knife blade or cutting member is normally fixedly retained upon the mounting plate.

However, when the pin plate is manually moved to a depressed position, against the biasing forces of the spring members operatively associated with the pin plate, the mounting pins are moved axially so as to effectively remove the second relatively large diameter portions of the mounting pins from the relatively enlarged circular portions of the key-hole slots defined within the knife blade or cutting member and to thereby permit the first relatively small diameter portions of the mounting pins to now be disposed within the relatively enlarged circular portions of the key-hole slots of the knife blade or cutting member and therefore be aligned with the relatively narrow elongated slot portions of the key-hole slots of the knife blade or cutting member. Accordingly, the knife blade or cutting member may simply be removed from the mounting plate as a result of the first relatively small diameter portions of the mounting pins effectively passing through the relatively narrow elongated slot portions of the key-hole slots defined within the knife blade or cutting member, and while, for example, the pin plate is maintained at its depressed position against the biasing forces of the spring members, a new or fresh knife blade or cutting member may simply be mounted upon the mounting plate. When the pin plate is then manually released, the biasing forces of the spring members will cause the pin plate to be returned to its original biased position so as to effectively force the second relatively large diameter portions of the mounting pins to re-enter the relatively enlarged circular portions of the key-hole slots defined within the new or fresh knife blade or cutting member so as to fixedly retain the new or fresh knife blade or cutting member upon the mounting plate.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

The SOLE FIGURE is an exploded perspective view of a new and improved quick change knife blade assembly which has been constructed in accordance with the principles and teachings of the present invention and which shows the cooperative parts thereof for use in conjunction with a tape roll dispensing cartridge assembly of a carton or case sealing machine.

DETAILED DESCRIPTION OF THE PREFERRED EMBODIMENT

Referring now to the drawings, and more particularly to the SOLE FIGURE thereof, a new and improved quick change knife blade assembly, constructed in accordance with the principles and teachings of the present invention and showing the cooperative parts thereof for use in conjunction with a tape roll dispensing cartridge assembly of a carton or case sealing machine, is disclosed and is generally indicated by the reference character 100. More particularly, it is seen that the new and improved quick change knife blade assembly 100 comprises a knife blade support arm 102 which is adapted to be pivotally mounted upon the framework of a carton or case sealing machine around a transverse axis 104 defined by means of a bushing member 106. The rear end portion of the knife blade support arm 102 is provided a transversely extending stud member 108, and a coil spring member 110 is provided such that a first hooked end portion 112 of the coil spring member 110 is adapted to be engaged within a grooved portion 114 of the transversely extending stud member 108 of the knife blade support arm 102, while a second hooked end portion 116 of the coil spring member 110 is adapted to be engaged with a portion of the tape roll dispensing cartridge assembly. In this manner, the rear end portion 118 of the knife blade support arm 102 will normally be biased downwardly such that the forward end portion 120 of the knife blade support arm 102 will normally be biased upwardly. In addition, a transversely oriented knife blade or cutting member mounting plate 122 is fixedly secured, at one end thereof, upon the knife blade support arm 102 at a position adjacent to the forward end portion 120 thereof, and a knife blade or cutting member 124 is adapted to be removably mounted upon the mounting plate 122 by means of structure which comprises the essence of the present invention such that the knife blade or cutting member 124 can in fact be removed from the knife blade or cutting member mounting plate 122, and replaced with a new or fresh knife blade or cutting member 124, in accordance with a quick-change replacement procedure.

More particularly, it is seen that the knife blade or cutting member 124 is provided with a plurality of cutting teeth 126, which are disposed within a transverse array along the upper edge portion of the knife blade or cutting member 124, and a pair of transversely spaced key-hole shaped slots 128 which extend inwardly from the lower edge portion of the knife blade or cutting member 124 and which effectively divide the lower portion of the knife blade or cutting member 124 into a dependent central region 130 and a pair of laterally outer dependent leg regions 132,132. The knife blade or cutting member mounting plate 122 is provided with a pair of retaining brackets 134,134 upon the forward surface portion thereof, and accordingly, when the knife blade or cutting member 124 is mounted upon the knife blade or cutting member mounting plate 122, the rear surface portion of the central region 130 of the knife blade or cutting member 124 will be disposed in contact with, or seated upon, the front surface portion of the knife blade or cutting member mounting plate, 122 while the pair of laterally outer dependent leg regions 132,132 of the knife blade or cutting member 124 will be disposed within the pockets or recesses effectively defined by means of the retaining brackets 134, 134. In order to actually removably mount the knife blade or cutting member 124 upon the mounting plate 122 in accordance with the aforenoted quick-change replacement procedure, a pair of mounting pins 136,136 are adapted to be inserted through the relatively enlarged upper circular portions of the transversely spaced key-hole shaped slots 128,128 defined within the knife blade or cut-ting member 124, and are also adapted to pass through a pair of transversely spaced apertures 138,138 which are defined within the mounting plate 122. In addition, a pin plate 140 is adapted to be movably mounted upon, or with respect to, the rear surface portion of the mounting plate 122, and it is seen that the pin plate 140 is also provided with a pair of transversely spaced apertures 142,142 through which externally threaded shaft members of suitable bolt fasteners, not shown, are adapted to pass. The shaft members of the mounting pins 136,136 are internally threaded or tapped so as to be adapted to receive the externally threaded shaft members of the bolt fasteners, not shown, and in this manner, the pin plate 140 will effectively be sandwiched between, for example, the distal ends of the shaft members of the mounting pins 136,136 and the headed portions of the bolt fasteners, not shown, such that the pin plate 140 is fixedly or integrally connected to the mounting pins 136,136 whereby the pin plate 140 and the mounting pins 136,136 will be movable together as a single entity.

In addition, a pair of coil springs 144,144 are adapted to be coaxially mounted upon or around the shaft members of the mounting pins 136,136 so as to be interposed between the rear surface portion of the mounting plate 122 and the front surface portion of the pin plate 140. In this manner, the front surface portion of the pin plate 140 will normally be biased away from the rear surface portion of the mounting plate 122 such that the mounting pins 136,136 will, in turn, be biased toward their rearwardmost or leftmost positions as may be considered or viewed in the SOLE FIGURE. It is to be noted that the shaft members of the mounting pins 136,136 actually have stepped configurations whereby the main or primary portions of the shaft members of the mounting pins 136,136 have first relatively small diametrical extents such that relative movement between such first relatively small diameter portions of the shaft members of the mounting pins 136, 136, and the relatively narrow elongated slot portions of the key-hole shaped slots 128,128 defined within the knife blade or cutting member 124, is permitted, however, those portions of the shaft members of the mounting pins 136,136 which are disposed immediately adjacent to the head portions of the mounting pins 136,136 have second relatively large diametrical extents whereby such second relatively large diameter portions of the shaft members of the mounting pins 136, 136 are able to be disposed within the relatively enlarged circular portions of the key-hole shaped slots 128,128, however, they cannot, in effect, pass through the relatively narrow elongated slot portions of the key-hole shaped slots 128,128 defined within the knife blade or cutting member 124.

In this manner, when the pin plate 140 is disposed at its normal position at which it is biased away from the mounting plate 122 by means of the coil springs 144,144, the second, relatively large diameter portions of the shaft members of the mounting pins 136,136 will be disposed within the relatively enlarged circular portions of the key-hole shaped slots 128, 128 of the knife blade or cutting member 124 whereby the knife blade or cutting member 124 cannot be removed from the mounting plate 122 in view of the fact that the second, relatively large diameter portions of the shaft members of the mounting pins 136,136 cannot, in effect, enter, or pass through, the relatively narrow elongated slot portions of the key-hole shaped slots 128,128 defined within the knife blade or cutting member 124 so as to in fact permit relative movement to occur between the knife blade or cutting member 124 and the mounting pins 136,136 disposed within the mounting plate 122.

On the other hand, when the pin plate 140 is manually depressed toward the mounting plate 122 against the biasing forces of the coil spring members 144,144 so as to axially compress the coil spring members 144,144, the mounting pins 136,136 will be moved axially forwardly such that the head portions of the mounting pins 136,136 will be moved away from the front surface portion of the knife blade or cutting member 124, and concomitantly therewith, the second relatively large diameter portions of the shaft members of the mounting pins 136,136 will effectively be removed from their dispositions within the relatively enlarged circular portions of the key-hole shaped slots 128,128 defined within the knife blade or cutting member 124 so as to now permit the first, relatively small diameter portions of the shaft members of the mounting pins 136,136 to be disposed within the relatively enlarged circular portions of the key-hole shaped slots 128,128 defined within the knife blade or cutting member 124 and thereby, in effect, be aligned in a coplanar manner with the relatively narrow elongated slot portions of the key-hole shaped slots 128,128 defined within the knife blade or cutting member 124.

Accordingly, these first, relatively small diameter portions of the shaft members of the mounting pins 136,136 will now be able to effectively pass through the relatively narrow elongated slot portions of the key-hole shaped slots 128,128 defined within the knife blade or cutting member 124 so as to in fact permit the knife blade or cutting member 124 to be quickly removed from the mounting plate 122. Still further, if the pin plate 140 is maintained at its depressed position, a new or fresh knife blade or cutting member 124 can be easily and quickly mounted upon the mounting plate 122 as a result of relative movement of the relatively narrow elongated slot portions of the key-hole shaped slots 128,128 defined within the new or fresh knife blade or cutting member 124 moving past, or relative to, the first, relatively small diameter portions of the shaft members of the mounting pins 136,136. Once the mounting pins 136,136 are effectively disposed within the relatively enlarged circular portions of the key-hole shaped slots 128, 128, release of the force or pressure upon the pin plate 140, so as to permit the same to be returned to its normal state biased by means of the coil spring members 144,144, will cause the second, relatively large diameter portions of the shaft members of the mounting pins 136,136 to again be disposed or seated within the relatively enlarged circular portions of the key-hole shaped slots 128, 128 defined within the new or fresh knife blade or cutting member 124 whereby the new or fresh knife blade or cutting member 124 will now be fixedly mounted upon the mounting plate 122 and cannot be removed therefrom unless or until the pin plate 140 is again depressed against the biasing forces of the coil spring members 144,144 so as to once again, in effect, align the first, relatively small diameter portions of the shaft members of the mounting pins 136,136 to again be aligned with the relatively narrow elongated slot portions of the key-hole shaped slots 128,128.

With reference still being made to the SOLE FIGURE, it was previously noted that the coil spring member 110 biases the knife blade support arm 102 in such a manner that the rear end portion 118 of the knife blade support arm 102 will normally be biased downwardly while the forward end portion 120 of the knife blade support arm 102 will normally be biased upwardly. When a carton or case is therefore being conveyed along its conveyance path so as to have sealing tape, from the tape roll dispensing cartridge assembly, applied thereto, the front or forward edge portion of the bottom or underside surface portion of the carton or case will in effect encounter the upwardly biased forward end portion 120 of the knife blade support arm 102, and in view of the fact that the carton or case is being conveyed along a horizontally oriented conveyor path, such front or forward edge portion of the bottom or underside surface portion of the carton or case will effectively force the upwardly biased forward end portion 120 of the knife blade support 102 angularly downwardly, against the biasing force of the coil spring member 110, such that the knife blade support arm is now disposed in a horizontal orientation whereby the carton or case will now be conveyed along the upper edge portion 146 of the horizontally oriented knife blade support arm 102. Recalling that the knife blade mounting plate 122, having the knife blade or cutting member 124 fixedly mounted thereon, is itself fixedly mounted upon the knife blade support arm 102 at a position adjacent to the forward end portion 120 thereof, it is to be appreciated that as the rear edge portion of the bottom or underside portion of the carton or case passes beyond the forward end portion 120 of the knife blade support arm 102, the knife blade support arm 102 will no longer be subjected to any downward pressure or force, as was the case when the carton or case was being conveyed along the upper edge portion 146 of the knife blade support arm 102, and accordingly, the coil spring member 110 will again bias or return the knife blade support arm 102 to its original position whereby the rear end portion 118 of the knife blade support arm 102 will be moved downwardly while the forward end portion 120 of the knife blade support arm 102 will be moved upwardly.

Since, as has been noted hereinbefore, the knife blade mounting plate 122, having the knife blade or cutting member 124 fixedly mounted thereon, is itself fixedly mounted upon the knife blade sup-port arm 102 at a position adjacent to the forward end portion 120 thereof, this mode of operation will thereby result in the knife blade or cutting member 124 being, in effect, moved suddenly upwardly whereby the knife blade or cutting member 124 will sever the sealing tape at a predetermined position rearwardly of the rear edge portion of the bottom or underside portion of the carton or case such that a predetermined length of the sealing tape can effectively be applied to the carton or case so as to effectively complete the carton or case sealing operation. It is further noted that a sealing tape adjustment mechanism 148 is also adapted to be adjustably mounted upon the forward end portion of the knife blade support arm 102. More particularly, the sealing tape adjustment mechanism 148 comprises an elongated plate having an elongated slot 150 defined therein. A pair of fasteners, not shown, are adapted to be inserted through the elongated slot 150 and fixedly secured within a pair of apertures 152 defined within the forward end portion 120 of the knife support arm 102.

In this manner, depending upon the relative disposition of the elongated plate 148 with respect to the forward end portion 120 of the knife blade support arm 102, as permitted by the relative disposition of the fasteners, not shown, within the elongated slot 150 of the elongated plate 148, the disposition of the forward end portion 154 of the elongated plate 148, with respect to the forward end portion 120 of the knife blade support arm 102, can be adjusted such that, for example, the forward end portion 154 of the elongated plate 148 can project beyond the forward end portion 120 of the knife blade support arm 102 by predeterminedly adjustable amounts. The adjustment mechanism, comprising the elongated plate 148, therefore effectively serves as an adjustable length extension of the forward end portion 120 of the knife blade support arm 102 such that when the bottom or underside portion of the carton or case being sealed passes beyond the forward end portion 120 of the knife blade support arm 102, downward pressure or force upon the knife blade support arm 102 will not in fact be released, as yet, in view of the fact that the bottom or undersurface portion of the carton or case will still be engaged with the adjustably mounted elongated plate 148 thereby preventing the knife blade or cutting member 124 from being moved upwardly to its cutting position. This permits the length dimension of the rearwardly extending portion of the sealing tape to be rendered adjustable depending upon the sealing parameters to be imparted to the particular carton or case being sealed.

It is lastly to be noted that a knife blade guard or cover 156 is adapted to be mounted upon the quick change knife blade assembly 100 so as to be movable between a first position at which the knife blade guard or cover encloses or covers the knife blade or cutting member 124 so as to effectively protect operator or maintenance personnel, and a second position at which the knife blade guard or cover completely uncovers or exposes the knife blade or cutting member 124 such that the knife blade or cutting member 124 can in fact perform its sealing tape cutting operation. More particularly, it is seen that the knife blade guard or cover 156 comprises a housing 158 and an upstanding tab member 160. In addition, it is seen that the knife blade mounting plate 122 is integrally provided with a pair of transversely spaced dependent leg members 162,162 within which a pair of transversely oriented throughbores or apertures 164,164 are respectively defined. In a similar manner, lower end portions of the knife blade guard housing 158 are respectively provided with a pair of transversely spaced apertures 166, only one of which is visible, and opposite ends of a pivot pin 168 are adapted to pass through the apertures 164,164 defined within the dependent leg portions 162,162 of the knife blade mounting plate 122. as well as through the apertures 166 defined within the knife blade guard housing 158 such that the knife blade guard housing 158 is pivotally mounted upon the knife blade mounting plate 122. Opposite ends of the pivot pin 168 have bushings 170, 170 mounted thereon, and a torsion spring 172 is adapted to be mounted upon a central portion of the pivot pin 168.

The torsion spring 172 comprises a first upstanding end portion 174 which is adapted to be engaged with a front surface portion of the knife blade guard housing 158, and a second dependent end portion 176 which is adapted to be engaged with a front surface portion of the knife blade mounting plate 122. In this manner, the torsion spring 172 normally biases the knife blade guard or cover 156 to its illustrated upstanding position at which the knife blade guard or cover 156 will in fact be disposed at its first position at which the knife blade guard or cover 156 does in fact enclose or cover the knife blade or cutting member 124. However, when the carton or case to be sealed is being conveyed along its conveyance path such that the front or forward edge portion of the bottom or undersurface portion of the carton or case will, in effect, cause the knife blade support arm 102 to be moved to its horizontal position, as has been noted hereinbefore, the front or forward edge portion of the bottom or undersurface portion of the carton or case will also encounter the upstanding tab member 160 of the knife blade guard or cover 156 so as to effectively rotate the knife blade guard or cover 156 from its illustrated upstanding position to an angularly displaced position, through means of an angle, for example, of 45°, against the biasing force of the torsion spring 172, so as to, in effect, partially uncover the knife blade or cutting member 124. Accordingly, when the rear edge portion of the bottom or undersurface portion of the carton or case passes beyond the forward end portion 120 of the knife blade support arm 102, or beyond the forward end portion 154 of the sealing tape adjustment mechanism 148 as has been discussed hereinbefore, the knife blade support arm 102 will be moved upwardly so as to permit the knife blade or cutting member 124 to approach the sealing tape and thereby sever the same, however, simultaneously therewith, in view of the fact that the tab member 160 of the knife blade guard or cover 156 is still engaged with the bottom or undersurface portion of the carton or case, the knife blade guard or cover 156 will be rotated still further in its opening or uncovering direction through a predetermined angular rotation, so as to attain its second position, which is, for example, 90° from its original upstanding covered position, whereby the knife blade or cutting member 124 is now fully uncovered and able to perform its sealing tape cutting operation.

It is to be noted that the tab member 160 of the knife blade guard or cover 156 has a length dimension which is sufficient so as to permit the distal end portion 178 of the tab member 160 to extend beyond the forward end portion 120 of the knife blade support arm 102, or beyond the forward end portion 154 of the sealing tape adjustment mechanism 148, such that even though the knife blade support arm 102 has been moved upwardly under the biasing force or influence of the coil spring 110, the knife blade guard or cover 156 is maintained at its second position at which the knife blade or cutting member 124 is entirely uncovered or exposed so as to perform its sealing tape cutting operation. When the carton or case to be sealed is conveyed along its conveyance path still further, subsequent to the cutting or severing of the sealing tape by means of the knife blade or cutting member 124, the rear edge portion of the bottom or undersurface portion of the carton or case will then pass beyond the distal end portion 178 of the tab member 160 of the knife blade guard or cover 156 so as to permit the torsion spring 172 to in fact return the knife blade guard or cover 156 to its original upstanding position at which it encloses or covers the knife blade or cutting member 124 whereby the knife blade assembly 100 is again ready for performing another sealing tape cutting operation.

Thus, it may be seen that in accordance with the principles and teachings of the present invention, there has been disclosed a new and improved quick change knife blade assembly, for use in conjunction with a tape roll dispensing cartridge assembly of a carton or case sealing machine, wherein the knife blade or cutting member is mounted upon a knife blade mounting plate, and wherein the knife blade or cutting member can be quickly replaced or exchanged as a result of the simple manual manipulation of the pin plate, against the biasing force of the coil springs, interposed between the mounting plate and the pin plate, so as to effectively release the knife blade or cutting member from its fixed disposition upon the mounting plate. In this manner, operator personnel, in lieu of maintenance personnel, can perform the exchange or replacement operation without the need for any special tools.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A quick change knife blade assembly, comprising:

a mounting plate;

a knife blade mounted upon said mounting plate;

said knife blade being provided with a pair of key-hole shaped slots having first relatively enlarged circular portions and second relatively narrow slot portions;

a pin plate having a pair of axially extending pins fixedly mounted in an integral manner thereon wherein said pins have first relatively large diametrical portions and second relatively small diametrical portions such that when said pin plate, and said pair of axially extending pins fixedly mounted thereon, is disposed at a first axial position with respect to said mounting plate, said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade whereby said knife blade is fixedly retained upon said mounting plate, whereas, when said pin plate, and said pair of axially extending pins fixedly mounted thereon, is axially moved to and disposed at a second axial position with respect to said mounting plate, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate; and a pair of biasing springs disposed around said second relatively small diametrical portions of said pair of pins so as to be operatively interposed between said mounting plate and said pin plate for normally biasing said pin plate, and said pair of axially extending pins fixedly mounted thereon, to said first axial position with respect to said mounting plate at which said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade such that said knife blade is fixedly retained upon said mounting plate, however, when said pin plate is depressed against the biasing force of said pair of biasing springs so as to axially move said pin plate, and said pair of pins mounted thereon, to said second axial position, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate.

2. The quick change knife blade assembly as set forth in claim 1, further comprising:

a pair of retaining brackets fixedly mounted upon said mounting plate for retaining said knife blade mounted upon said mounting plate.

3. A quick change knife blade assembly for use within a case sealing machine for cutting sealing tape used for sealing cases, comprising:

a support arm;

a mounting plate fixedly mounted upon said support arm;

a knife blade mounted upon said mounting plate;

said knife blade being provided with a pair of key-hole shaped slots having first relatively enlarged circular portions and second relatively narrow slot portions;

a pin plate having a pair of axially extending pins fixedly mounted in an integral manner thereon wherein said pins have first relatively large diametrical portions and second relatively small diametrical portions such that when said pin plate, and said pair of axially extending pins fixedly mounted thereon, is disposed at a first axial position with respect to said mounting plate, said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade whereby said knife blade is fixedly retained upon said mounting plate, whereas, when said pin plate, and said pair of axially extending pins fixedly mounted thereon, is axially moved to and disposed at a second axial position with respect to said mounting plate, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate; and a pair of biasing springs disposed around said second relatively small diametrical portions of said pair of pins so as to be operatively interposed between said mounting plate and said pin plate for normally biasing said pin plate, and said pair of axially extending pins fixedly mounted thereon, to said first axial position with respect to said mounting plate at which said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade such that said knife blade is fixedly retained upon said mounting plate, however, when said pin plate is depressed against the biasing force of said pair of biasing springs so as to axially move said pin plate, and said pair of pins mounted thereon, to said second axial position, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate.

4. The assembly as set forth in claim 3, wherein:

said support arm is movably mounted between a first position at which said knife blade is disposed at a first inoperative position with respect to a sealing tape used to seal a case to be sealed, and a second position at which said knife blade is disposed at a second operative position, with respect to the sealing tape used to seal the case to be sealed, so as to cut the sealing tape at the conclusion of a case sealing operation.

5. The assembly as set forth in claim 4, wherein:

said support arm is pivotally movable between said first and second positions.

6. The assembly as set forth in claim 5, further comprising:

a biasing spring operatively connected to said support arm for normally biasing said support arm, and said knife blade mounted thereon, toward said second operative position.

7. The assembly as set forth in claim 3, further comprising:

a knife blade cover which is movable between first and second positions at which said knife blade cover respectively covers said knife blade when said knife blade cover is disposed at said first position, and uncovers said knife blade when said knife blade cover is disposed at said second position.

8. The assembly as set forth in claim 7, wherein:

wherein said knife blade cover is pivotally mounted between said first and second positions so as to cover and uncover said knife blade.

9. The quick change knife blade assembly as set forth in claim 3, further comprising:

a pair of retaining brackets fixedly mounted upon said mounting plate for retaining said knife blade mounted upon said mounting plate.

10. A method of quickly permitting a knife blade to be removed from and mounted upon a knife blade assembly, comprising the steps of:

providing a mounting plate;

mounting a knife blade upon said mounting plate;

providing said knife blade with a pair of key-hole shaped slots having first relatively enlarged circular portions and second relatively narrow slot portions;

providing a pin plate having a pair of axially extending pins fixedly mounted in an integral manner thereon wherein said pins have first relatively large diametrical portions and second relatively small diametrical portions such that when said pin plate, and said pair of axially extending pins fixedly mounted thereon, is disposed at a first axial position with respect to said mounting plate, said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade whereby said knife blade is fixedly retained upon said mounting plate, whereas, when said pin plate, and said pair of axially extending pins fixedly mounted thereon, is axially moved to and disposed at a second axial position with respect to said mounting plate, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate;

mounting a pair of biasing springs disposed around said second relatively small diametrical portions of said pair of pins so as to be operatively interposed between said mounting plate and said pin plate for normally biasing said pin plate, and said pair of axially extending pins fixedly mounted thereon, to said first axial position with respect to said mounting plate at which said first relatively large diametrical portions of said pair of pins will be disposed within said first relatively enlarged circular portions of said knife blade so as to prevent said first relatively large diametrical portions of said pair of pins from moving through said second relatively narrow slot portions of said key-hole shaped slots of said knife blade such that said knife blade is fixedly retained upon said mounting plate, however, when said pin plate is depressed against the biasing force of said pair of biasing springs so as to axially move said pin plate, and said pair of pins mounted thereon, to said second axial position, said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate;

depressing said pin plate is against the biasing force of said pair of biasing springs so as to move said pin plate and said pair of pins to said second position such that said first relatively large diametrical portions of said pair of pins will be disengaged from said first relatively enlarged circular portions of said knife blade and said second relatively small diametrical portions of said pair of pins will be disposed within said first relatively enlarged circular portions of said knife blade so as to permit said second relatively small diametrical portions of said pair of pins to move through said second relatively narrow slot portions of said key-hole shaped slots of said knife blade whereby said knife blade can be removed from said mounting plate;

while said pin plate is maintained at its depressed position, a new knife blade may be inserted onto said mounting plate; and releasing the depression force upon said pin plate so as to permit said biasing springs to return said pin plate to said first position so as to lockingly retain said new knife blade upon said mounting plate.

11. The method as set forth in claim 10, further comprising the step of:

providing a pair of retaining brackets fixedly mounted upon said mounting plate for retaining said knife blade mounted upon said mounting plate.

* * * * *